US010961835B2

(12) United States Patent
Mazrooee et al.

(10) Patent No.: US 10,961,835 B2
(45) Date of Patent: Mar. 30, 2021

(54) AUTOMATED RATE CONTROL SYSTEM FOR HYDRAULIC FRACTURING

(71) Applicant: Halliburton Energy Services, Inc., Houston, TX (US)

(72) Inventors: Mehdi Mazrooee, Double Oak, TX (US); Matthew Lewis Lahman, Houston, TX (US); Stephen Byrne Persac, Shreveport, LA (US); Michael Linley Fripp, Denton, TX (US); Mark Allen Adams, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 159 days.

(21) Appl. No.: 16/331,924

(22) PCT Filed: Dec. 30, 2016

(86) PCT No.: PCT/US2016/069360
§ 371 (c)(1),
(2) Date: Mar. 8, 2019

(87) PCT Pub. No.: WO2018/125176
PCT Pub. Date: Jul. 5, 2018

(65) Prior Publication Data

US 2020/0256177 A1 Aug. 13, 2020

(51) Int. Cl.
*E21B 43/267* (2006.01)
*E21B 43/26* (2006.01)
(Continued)

(52) U.S. Cl.
CPC ..... *E21B 43/267* (2013.01); *E21B 41/0092* (2013.01); *E21B 43/2607* (2020.05);
(Continued)

(58) Field of Classification Search
CPC .... E21B 43/26; E21B 43/2607; E21B 43/267; E21B 41/0092; E21B 47/06; E21B 47/10;
(Continued)

(56) References Cited

U.S. PATENT DOCUMENTS 5,517,854 A 5/1996 Plumb et al.
6,935,424 B2 8/2005 Lehman et al.
(Continued)

FOREIGN PATENT DOCUMENTS

WO 2011119668 A1 9/2011

OTHER PUBLICATIONS

International Search Report & Written Opinion issued for corresponding International Application No. PCT/ US2016/069360 dated Sep. 26, 2017. (16 pages).

*Primary Examiner* — Michael R Wills, III
(74) *Attorney, Agent, or Firm* — McGuireWoods LLP

(57) ABSTRACT

A method for hydraulically fracturing a subterranean formation includes preparing and sending a first command signal from a master controller to a plurality of pumps of a pump system. The first command signal specifies a flow rate output for each in pump to achieve a first target flow rate for a fracturing fluid being injected into the subterranean formation. A pressure of the fracturing fluid injected into the subterranean formation at the first target flow rate is monitored and, based on the pressure, the master controller determines when to increase a flow rate of the fracturing fluid to a second target flow rate. The master controller prepares and sends a second command signal to the plurality of pumps to specify the flow rate output for each pump to achieve the second target flow rate.

20 Claims, 5 Drawing Sheets

(51) Int. Cl.

| | |
|---|---|
| ***E21B 41/00*** | (2006.01) |
| ***E21B 47/06*** | (2012.01) |
| ***E21B 47/10*** | (2012.01) |
| ***F04B 15/00*** | (2006.01) |
| ***F04B 49/00*** | (2006.01) |

(52) U.S. Cl.
CPC ..... *E21B 47/06* (2013.01); *E21B 47/10* (2013.01); *F04B 15/00* (2013.01); *F04B 49/00* (2013.01); *F04B 2207/02* (2013.01)

(58) Field of Classification Search
CPC ..... E21B 43/14; F04B 15/00; F04B 49/00; F04B 2207/02
See application file for complete search history.

(56) References Cited

U.S. PATENT DOCUMENTS

| | | | | |
|---|---|---|---|---|
| 7,516,793 | B2 | 4/2009 | Dykstra | |
| 10,018,020 | B2 * | 7/2018 | Phillippi | F04D 13/12 |
| 2009/0053072 | A1 | 2/2009 | Borgstadt et al. | |
| 2010/0310384 | A1 | 12/2010 | Stephenson et al. | |
| 2013/0220605 | A1 * | 8/2013 | Vandor | C09K 8/62 166/267 |
| 2015/0083400 | A1 * | 3/2015 | Stephenson | E21B 43/267 166/250.01 |
| 2016/0265330 | A1 * | 9/2016 | Mazrooee | E21B 43/26 |
| 2016/0273346 | A1 | 9/2016 | Tang et al. | |
| 2020/0182236 | A1 * | 6/2020 | Beisel | F04B 49/065 |

* cited by examiner

AUTOMATED RATE CONTROL SYSTEM FOR HYDRAULIC FRACTURING

BACKGROUND

Subterranean hydraulic fracturing (alternately referred to as "fracking") is sometimes conducted to increase or stimulate production from hydrocarbon-producing wells. In hydraulic fracturing, a fracturing fluid is pumped at an elevated pressure from a wellbore into adjacent hydrocarbon-bearing subterranean formations. The pumped fracturing fluid splits or "fractures" the rock formation along veins or planes extending laterally from the wellbore. In some applications, the fracturing fluid contains propping agents (alternately referred to as "proppant") that are also injected into the opened fractures. Once a desired fracture network is formed, the fluid flow is reversed and the liquid portion of the fracturing fluid is removed. The proppant is intentionally left behind to prevent the fractures from closing onto themselves due to the weight and stresses within the formation. Accordingly, the proppant quite literally "props" or supports the fractures to remain open, yet remain permeable to hydrocarbon fluid flow since they form a packed bed of particles with interstitial void space connectivity.

Hydraulic fractures near the wellbore wall are ideally simple, straight, and wide to provide a direct fluid pathway between the wellbore and the deeper parts of the formation. Once farther into the formation, then it is preferable to generate a complex fracture network that maximizes reservoir contact.

While intended to enhance hydrocarbon production, hydraulic fracturing can occasionally damage rather than help the formation. One type of damage caused by hydraulic fracturing is referred to as "screenout," also known as "sandout." Screenout is a condition that occurs when the fracture network at or near the wellbore wall becomes too complex or restricted and the proppant substantially plugs the fractures and thereby prevents the fracturing fluid from flowing deeper into the formation at that location. Ramping up the flow rate too quickly during the initial stages of hydraulic fracturing is often the root-cause in screenout. Ramping up the flow rate too quickly, for example, causes rapid fluid pressurization in the wellbore (i.e., breakdown overpressure), which can lead to poor near wellbore fracture geometry, multiple competing fractures, and too many dominant fractures taking fluid, each of which can lead to premature screenout during later fracturing stages when proppant is introduced into the formation. When uncontrolled increases in flow rate are applied during initial fracturing, pressures quickly become too high, then, too many fractures near the wellbore wall may be taking fluid or they may follow torturous paths and, as a result, the widths of each fracture will become insufficient, causing fewer initial fractures to accept proppant during later pump stages. The remaining fractures would then remain untreated, resulting in significant bypassed oil and gas reserves in the reservoir.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

The present disclosure is related to hydraulic fracturing of subterranean hydrocarbon-producing wells and, more particularly, to real-time and automatic control of hydraulic fracturing operations for stimulating the production of hydrocarbons.

Embodiments discussed herein describe the use of a hydraulic fracturing control system that incorporates a master controller used to provide automatic control over the stepped flow rate control for driving the fracture opening stages of the initial breakdown stages of hydraulic fracturing. The master controller operates and directs a series of pumps to control the flow rate output from each pump. The master controller commands the set point for each pump based on the available capacity of each pump, the relative output from each pump, and/or the total flow required into the wellbore. One advantage of the presently described embodiments is that the master controller determines the timing of the rate steps and/or the magnitude of the rate steps based on the pressure-time behavior of the injection process.

The systems and methods disclosed herein may be suitable for use during subterranean operations such as fracturing in the oil and gas industry. However, it will be appreciated that the various disclosed systems and methods are equally applicable during other subterranean operations, such as cementing, drilling, etc. as described above. Moreover, the systems and methods disclosed herein may be applicable to other fields requiring tunable fluids during operation including, but not limited to, the food industry, the drug industry, the mining industry, etc.

Figure 1:
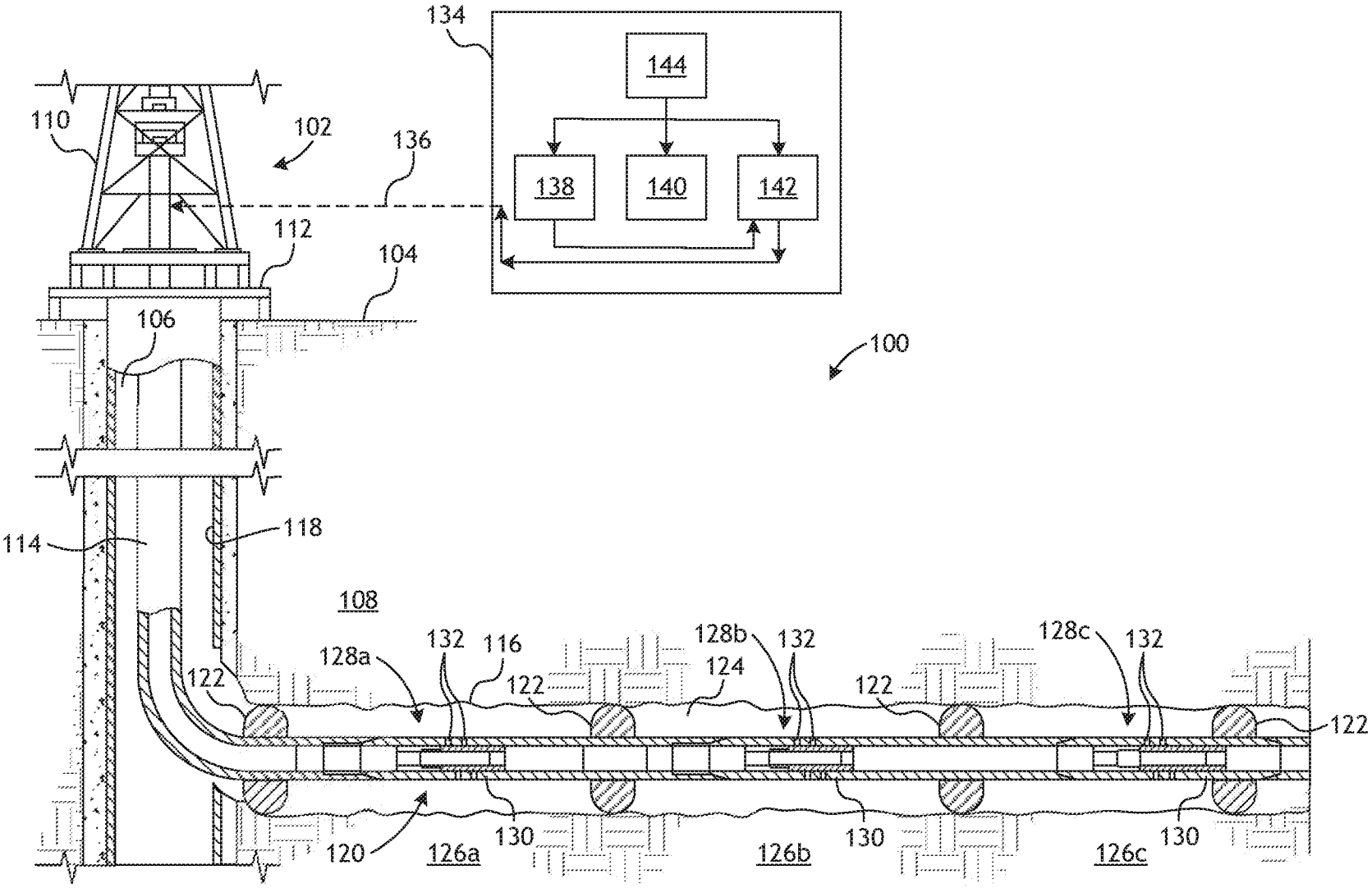
FIG. 1 illustrates an exemplary well system that can embody or otherwise employ one or more principles of the present disclosure.

FIG. 1 is a schematic diagram of an example well system 100 that can embody or otherwise employ one or more principles of the present disclosure, according to one or more embodiments. As illustrated, the well system 100 includes an oil and gas rig 102 arranged at the Earth's surface 104 and a wellbore 106 extends from the rig 102 and penetrates a subterranean earth formation 108. Even though FIG. 1 depicts a land-based rig 102, the embodiments of the present disclosure are equally well suited for use by other types of rigs, such as offshore platforms, or rigs used in any other geographical location. Moreover, in other embodiments, the rig 102 may be replaced with a wellhead installation, without departing from the scope of the disclosure.

The rig 102 may include a derrick 110 and a rig floor 112, and the derrick 110 may support or otherwise help manipulate the axial position of a work string 114 extended within the wellbore 106 from the rig floor 112. As used herein, the term "work string" refers to one or more types of connected lengths of tubulars or pipe, such as drill pipe, drill string, landing string, production tubing, coiled tubing, combinations thereof, or the like. The work string 114 may be used to stimulate (i.e., hydraulically fracture or "frack") portions of the wellbore 106 using the systems and methods described herein. In other embodiments, however, the work string 114 may be entirely omitted from the system 100 and the wellbore 106 may nonetheless be stimulated using the systems and methods described herein. Accordingly, inclusion of the work string 114 is for purposes of discussion only and should not be considered to limit the scope of the present disclosure.

As illustrated, the wellbore 106 extends vertically away from the surface 104 and a branch or lateral wellbore 116 extends laterally from the wellbore 106. Alternatively, the wellbore 106 itself may instead deviate from vertical to form the lateral wellbore 116 across a deviated or horizontal portion thereof. In an embodiment, the wellbore 106 may be at least partially lined with a casing string 118 or may otherwise remain at least partially uncased. The lateral wellbore 116 is depicted as an uncased or "open hole" section of the wellbore 106, but could alternatively be lined with the casing string 118 also.

In the illustrated embodiment, the work string 114 is coupled to a completion assembly 120 extended into and deployed in the lateral wellbore 116 using one or more packers 122. The packers 122 seal the annulus 124 defined between the completion assembly 120 and the inner wall of the wellbore 106 and thereby effectively divide the subterranean formation 108 into multiple production intervals 126 or "pay zones," shown as intervals 126*a*, 126*b*, and 126*c*. Each interval 126*a-c* may be independently or simultaneously stimulated (e.g., hydraulically fractured or "fracked") using the systems and methods described herein. While three production intervals 126*a-c* are shown in FIG. 1, any number of intervals 126*a-c* may be defined in the well system 100, including a single production interval, without departing from the scope of the disclosure.

In the illustrated embodiment, a sliding sleeve assembly 128 is arranged within the work string 114 at each interval 126*a-c* (shown as sliding sleeve assemblies 128*a*, 128*b*, and 128*c*). Each sliding sleeve assembly 128*a-c* may include a sliding sleeve 130 that is axially movable within the work string 114 to expose or occlude one or more ports 132 defined therein. Once exposed, the ports 132 may facilitate fluid communication into the annulus 124 from the interior of the work string 114 such that hydraulic fracturing operations may be undertaken in each corresponding interval 128*a-c*.

In other embodiments, however, the completion assembly 120 may be omitted from the well system 100 and the lateral wellbore 116 may instead be lined with casing (e.g., the casing string 118) and perforated in strategic locations to facilitate fluid communication between the interior of the casing and each corresponding interval 128*a-c*. In such embodiments, the wellbore 106 may nonetheless be stimulated using the systems and methods described herein by hydraulically fracturing the formation 108 via the perforations.

To facilitate hydraulic fracturing of the formation 108, the system 100 may also include a fracturing control system 134. The fracturing control system 134 communicates with the work string 114 (or alternatively the casing string 118) so that a prepared fracturing fluid 136 can be pumped down the work string 114 and into selected intervals 128*a-c* to fracture the formation 108 adjacent the corresponding intervals 128*a-c*. As illustrated, the fracturing control system 134 includes a fluid system 138, a proppant system 140, a pump system 142, and a master controller 144. In some embodiments, as illustrated, the fracturing control system 134 may be arranged at the surface 104 adjacent the rig 102. In other embodiments, however, at least the master controller 144 may be remotely located and able to communicate with the systems 138, 140, 142 via wired or wireless telecommunication means.

The fluid system 138 may be used to mix and dispense the fracturing fluid 136 having desired fluid properties (e.g., viscosity, density, fluid quality, etc.). The fluid system 138 may include a blender and sources of known substances that are combined in the blender to produce the fracturing fluid 136. The blending and mixing of the known substances is controlled under operation of the master controller 144.

The proppant system 140 may include proppant contained in one or more proppant storage devices, and a transfer apparatus that conveys the proppant from the storage device(s) to the fluid system 138 for blending. In some applications, the proppant system 140 may also include a proportional control device responsive to the master controller 144 to drive the transfer apparatus at a desired rate and thereby add a desired or predetermined quantity of proppant to the fracturing fluid 136.

The pump system 142 receives the prepared fracturing fluid 136 from the fluid system 138 and includes a series of positive displacement pumps (referred to as fracturing or "frac" pumps) that inject the fracturing fluid 136 into the wellbore 106 under specified pressures and at predetermined flow rates. Operation of the pumps of the pump system 142, including manipulation of the pump rate and pressure, is controlled by the master controller 144. Each pump may be indicative of a single, discrete pumping device, but could alternatively comprise multiple pumps included on or forming part of a pump truck stationed at or near the rig 102. All of the pumps (or pump trucks) included in the pump system 142 may or may not be the same type, size, configuration, or from the same manufacturer. Rather, some or all of the pumps may be unique in size, output capability, etc.

The master controller 144 includes hardware and software (e.g., a programmed computer) that allow a well operator to manually or autonomously control the fluid, proppant, and pump systems 138, 140, 142. Data from the fracturing operation, including real-time data from the wellbore 106 and the systems 138, 140, 142 is received and processed by the master controller 144 to provide monitoring and other informational displays to the well operator. In response to such real-time data, the master controller 144 provides control (command) signals to the systems 138, 140, 142 to trigger and adjust operation. Such control signals can either be conveyed manually, such as via functional input from the well operator, or automatically (autonomously), such as via programming included in the master controller 144 that automatically operates in response to real-time data triggers.

The master controller 144 may comprise an automated controller on a Controlled Breakdown Technology (CBT) management system. Controlled Breakdown Technology is a pressure-flow management procedure used in tight formations during the initial breakdown (fracturing) of a subterranean formation (e.g., the formation 108) and during the primary rate increase portion of the simulation treatment. This management procedure uses specific fluids for initiating the fractures and then uses a defined rate control logic to manage the pressure while achieving the designed job rate. In at least one embodiment, the CBT process may be initially used with low or no proppant concentration and the bulk of the proppant may instead be delivered at a later stage in the fracturing treatment.

The master controller 144 may be configured to issue control (command) signals that specify or dictate the flow rate produced by the pump system 142 and, more particularly, from each pump included therein. As described below, each pump may include a local controller and a dedicated local pump feedback loop. The local controller(s) may be configured and otherwise programmed to adjust local operation of the corresponding pump to match the flow rate specified (commanded) by the master controller 144. Thus, the fracturing control system 134 may include a nested series of local controllers that controls a corresponding series of pumps of the pump system 142, and the master controller 144 is programmed to coordinate and control the pumps based, at least in part, on feedback information obtained from the local pump feedback loops.

During the initial stages, and during the primary flow rate increase of the stimulation treatment, it is preferred to ramp the applied flow rate of the fracturing fluid 136 in stages or steps. This allows the resulting fractures to open and accommodate a higher flow in a step-wise fashion, which creates less complex fractures near the wall of the wellbore 106. By applying the flow rate and pressure in controlled steps, it is expected that all of the initial formation fractures will simultaneously take fluid and thereby mitigate or entirely prevent the occurrence of screenout (or "sandout").

According to embodiments of the present disclosure, operation of the master controller 144 may help provide efficient hydraulic fracturing that avoids or substantially avoids screenout events during the initial stages of fracturing the formation 108. As described herein below, the master controller 144 is programmed and otherwise configured to determine (calculate) and/or trigger when the next rate step should be applied and dictate how much of an increase in flow rate the next step should reflect. These parameters may be based on the pressure-time history of the hydraulic fracturing operation and the master controller 144 may be configured to automatically control the pumps of the pump system 142 to achieve a desired pressure profile at each stage of the operation.

In some embodiments, as described in more detail below, the master controller 144 may be programmed to employ automated algorithms that determine and apply a specific slope for each flow rate increase (the time to reach each set point), and a specific magnitude (flow rate in barrels per minute). As discussed below, the timing of each flow rate increase may be determined by the pressure-slope response of the previous rate step increase. Only when specific pressure response conditions to each rate step increase are observed will the next rate step be triggered by the master controller 144. In other embodiments, however, the master controller 144 may be programmed to employ automated algorithms that trigger a flow rate increase based on other operational or predetermined parameters, as described herein below.

Using the systems and methods described herein, a well operator will have control or influence over the propagation of the resulting fracture network. The result is improved fracture geometry, enhanced fracture breakdown, better flow distribution across (through) the fractures, and a significant improvement in intra-stage diversion. These performance advantages are in addition to the improvements in mitigating or entirely preventing screenout events.

Figure 2:
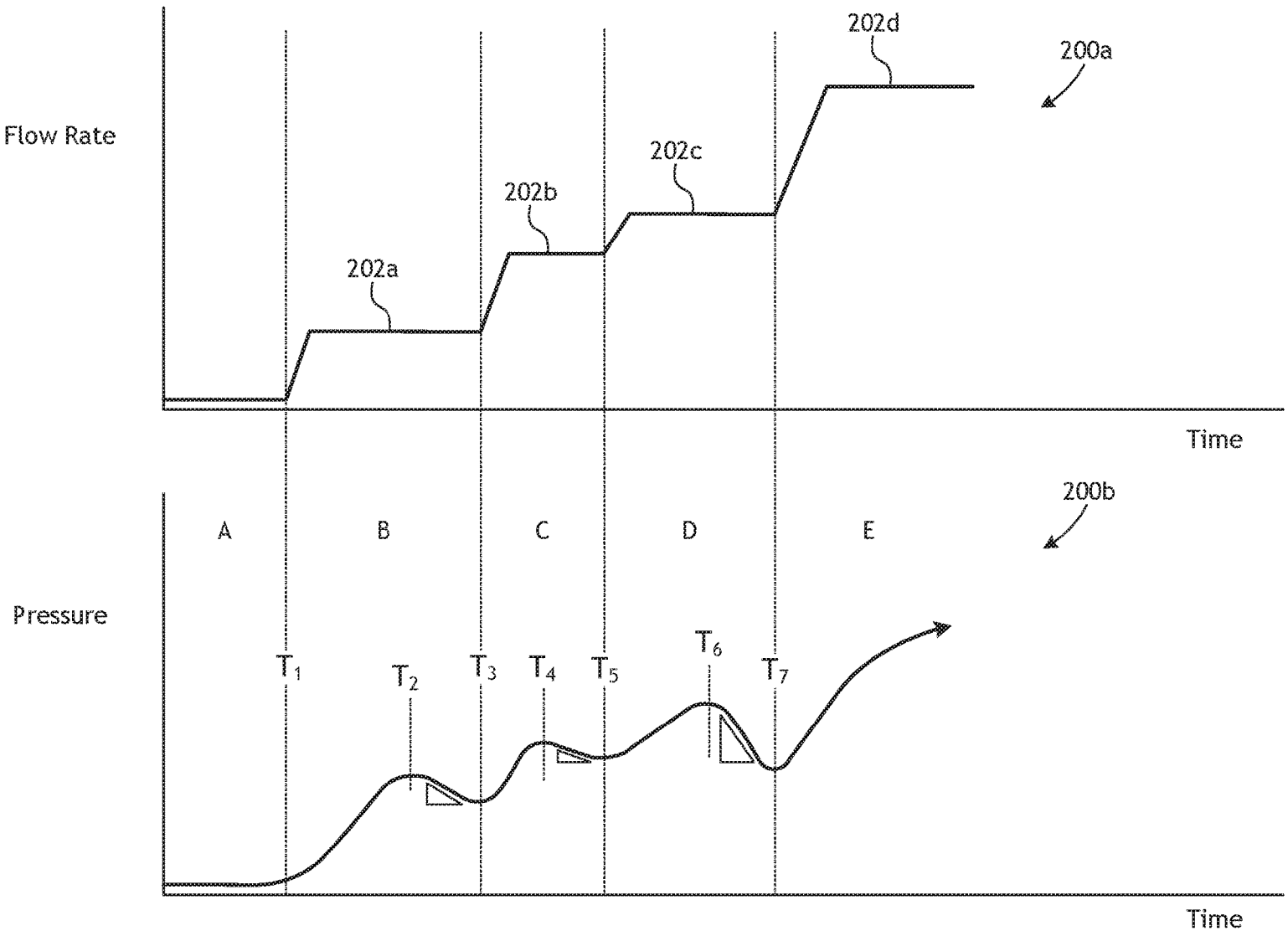
FIG. 2 depicts pressure and flow rate curves that reflect example automated operation of the fracturing control system of FIG. 1.

With continued reference to FIG. 1, FIG. 2 provides pressure-flow rate curves 200*a* and 200*b* that reflect example automated operation of the fracturing control system 134 of FIG. 1. More specifically, the first curve 200*a* provides example flow rate versus time data and the second curve 200*b* provides example pressure versus time data, where the time in each curve 200*a,b* is contiguous. The curves 200*a,b* are divided into five successive steps with respect to time, shown as step A, step B, step C, step D, and step E. Variations in each curve 200*a,b* are based partly on control dictated by the master controller 144, which is programmed to specify the flow rate for each pump of the pump system 142. As discussed below, the master controller 144 may also be programmed to monitor the pressure of the fracturing fluid 136 being delivered to the wellbore 106 and make any necessary flow rate adjustments to meet desired or predetermined fracturing pressures.

In example operation, as depicted in the curves 200*a,b*, across step A there is no flow rate and no applied pressure being delivered to the wellbore 106. At time $T_1$, however, the master controller 144 issues a first command signal to the pump system 142 that specifies a first increase in the flow rate for step B and the flow output from one or more pumps is thereby increased to a first target flow rate 202*a*. As a result, the wellbore pressure correspondingly increases but eventually reaches a maximum pressure for step B at time $T_2$, at which point the pressure may begin to decline (decrease). A second command signal may subsequently be issued to the pump system 142 by the master controller 144 at time $T_3$, which specifies a second increase in the flow rate corresponding to step C, and the flow output from the pump(s) is thereby increased to a second target flow rate 202*b*. The wellbore pressure again correspondingly increases but eventually reaches a maximum pressure for step C at time $T_4$, at which point the pressure may again begin to decrease.

A third command signal may subsequently be issued to the pump system 142 by the master controller 144 at time $T_5$, which specifies a third increase in the flow rate corresponding to step D, and the flow output from the pump(s) is thereby increased to a third target flow rate 202*c*. As a result, the wellbore pressure correspondingly increases but eventually reaches a maximum pressure for step D at time $T_6$, at which point the pressure may again begin to decrease. Lastly, a fourth command signal may subsequently be issued to the pump system 142 by the master controller 144 at time $T_7$, which specifies a fourth increase in the flow rate corresponding to step E, and the flow output from the pump(s) is thereby increased to a fourth target flow rate 202*d* and the wellbore pressure correspondingly increases. This process continues until a predetermined maximum target flow rate and pressure for the wellbore 106 is reached.

In some embodiments, the time between reaching a maximum pressure in a given step and the time when a new command signal is sent by the master controller 144 to increase the flow rate to a new target flow rate may be based on the determination (calculation) of a negative slope in the pressure-time curve 200*b* after reaching the maximum pressure in the given step. In other words, the time lapse between time $T_2$ and time $T_3$ (or alternatively between time $T_4$ and time $T_5$ or between time $T_6$ and time $T_7$) may encompass the time required to determine if the slope of the pressure-time curve 200*b* following time $T_2$ is negative, which would provide positive indication that the wellbore pressure is declining. Accordingly, once a negative slope following time $T_2$ is determined, the master controller 144 may be configured to issue the second command signal $T_3$. In the illustrated example, there are similar negative slopes in the pressure-time curve 200*b* between time $T_4$ and time $T_5$ and between time $T_6$ and time $T_7$, which results in corresponding third and fourth command signals being issued by the master controller 144 to increase the flow rate at time $T_5$ and time $T_7$, respectively.

In other embodiments, the time between reaching a maximum pressure in a given step and the time when a new command signal is sent by the master controller 144 to increase the flow rate to a new target flow rate may comprise a predetermined value. In other words, the time lapse between times $T_2$ and $T_3$ (or alternatively between times $T_4$ and $T_5$ or between times $T_6$ and $T_7$) can comprise a predetermined value. This predetermined value may be, for example, a predetermined or predefined time period, such as 1 second, 2 seconds, 5 seconds, 10 seconds, 30 seconds, more than 30 seconds, any time therebetween, or any time prior to 1 second (i.e., a split second) or after 30 seconds. The predetermined value may alternatively be based on wellbore data, such as the type of formation rock being fractured or historical logging data points.

In yet other embodiments, the time between reaching a maximum pressure in a given step (e.g., time $T_2$, $T_4$, or $T_6$) and the time when a new command signal is sent by the master controller 144 to increase the flow rate to a new target flow rate (e.g., time $T_3$, $T_5$, or $T_7$) may be adjusted based on the time elapsed between issuing the prior command signal and reaching the previous maximum pressure. In other words, the time between times $T_2$ and $T_3$ (or alternatively between times $T_4$ and $T_5$ or between times $T_6$ and $T_7$) can be adjusted based on the time elapsed between time $T_1$, when the first command signal was issued, and time $T_2$, when the wellbore pressure reached the maximum pressure for step B. Similar determinations (calculations) may be made between times $T_3$ and $T_4$ or between times $T_5$ and $T_6$.

In some embodiments, the flow rate increase to each step A, B, C, D may be the same and otherwise at a consistent (constant) rate across each step A, B, C, D. In such embodiments, the command signals issued by the master controller 144 may be configured to increase the flow rate at times T1, T3, T5, and T7 by a predetermined and comparable (similar) rate such that the target flow rate for each step A, B, C, D reflects flow rate increases at the same rate or intensity. As a result, the magnitude of each flow rate increase may be similar in one or both of the curves 200*a,b*. Consequently, in such embodiments, the commanded change (increase) in flow rate at time T1 would be the same as the commanded increase at times T3, T5, and T7. In other embodiments, however, the rate of increase of the flow rate at each step A, B, C, D need not be consistent (constant) across each step A, B, C, D. Rather, in such embodiments, the master controller 144 may be programmed to specify a variable rate of increase.

In yet other embodiments, the flow rate increase initiated at times $T_1$, $T_3$, $T_5$, and $T_7$ may be based on a parameter of the pressure-time curve 200*b* across the preceding step A, B, C, D. For example, the command signals issued by the master controller 144 may be configured to increase the flow rate at times $T_1$, $T_3$, $T_5$, and $T_7$ based on the slope of the pressure-time curve across the preceding step A, B, C, D, respectively. In some cases, the flow rate increase may be based on the slope of the pressure-time curve 200*b* during a pressure decrease. In such cases, the flow rate change at time $T_3$ would be a function of the slope of the pressure-time curve 200*b* between times $T_2$ and $T_3$. Similarly, the pressure slope after time $T_4$ is shallower (less aggressive) and thus the flow rate increase is smaller at time $T_5$, and the pressure slope after time $T_6$ is steeper (more aggressive) and, thus, the rate increase is larger at time $T_7$. In other cases, however, the flow rate increase may be based on the slope of the pressure-time curve 200*b* during a pressure increase, such as between times $T_1$ and $T_2$, times $T_3$ and $T_4$, and times $T_5$ and $T_6$, without departing from the scope of the disclosure.

In some applications, the pressure-time curve 200*b* may never register a decrease within a given step A, B, C, D, unlike the pressure decreases depicted between times $T_2$ to $T_3$, $T_4$ to $T_5$, and $T_6$ to $T_7$. In such applications, the master controller 244 may be programmed to eventually "time out" as it waits for an inflection point in the pressure-time curve 200*b*. More specifically, if too much time elapses after reaching a maximum pressure in a given step without measuring an inflection point in the pressure-time curve 200*b*, the master controller 144 may be programmed to issue a new command signal to increase the flow rate to a new target flow rate. In some embodiments, the "time out" period may be a predetermined value, such as the predetermined or predefined time limit discussed above (e.g., 1 second, 2 seconds, 5 seconds, 10 seconds, 30 seconds, more than 30 seconds, etc.). In other embodiments, the "time out" period may be determined based on the slope of the pressure-time curve 200*b* during a pressure increase or decrease. In yet other embodiments, the "time out" period may be the time elapsed during the previous step. In even further embodiments, the "time out" period may be a combination of any of the foregoing.

Figure 3:
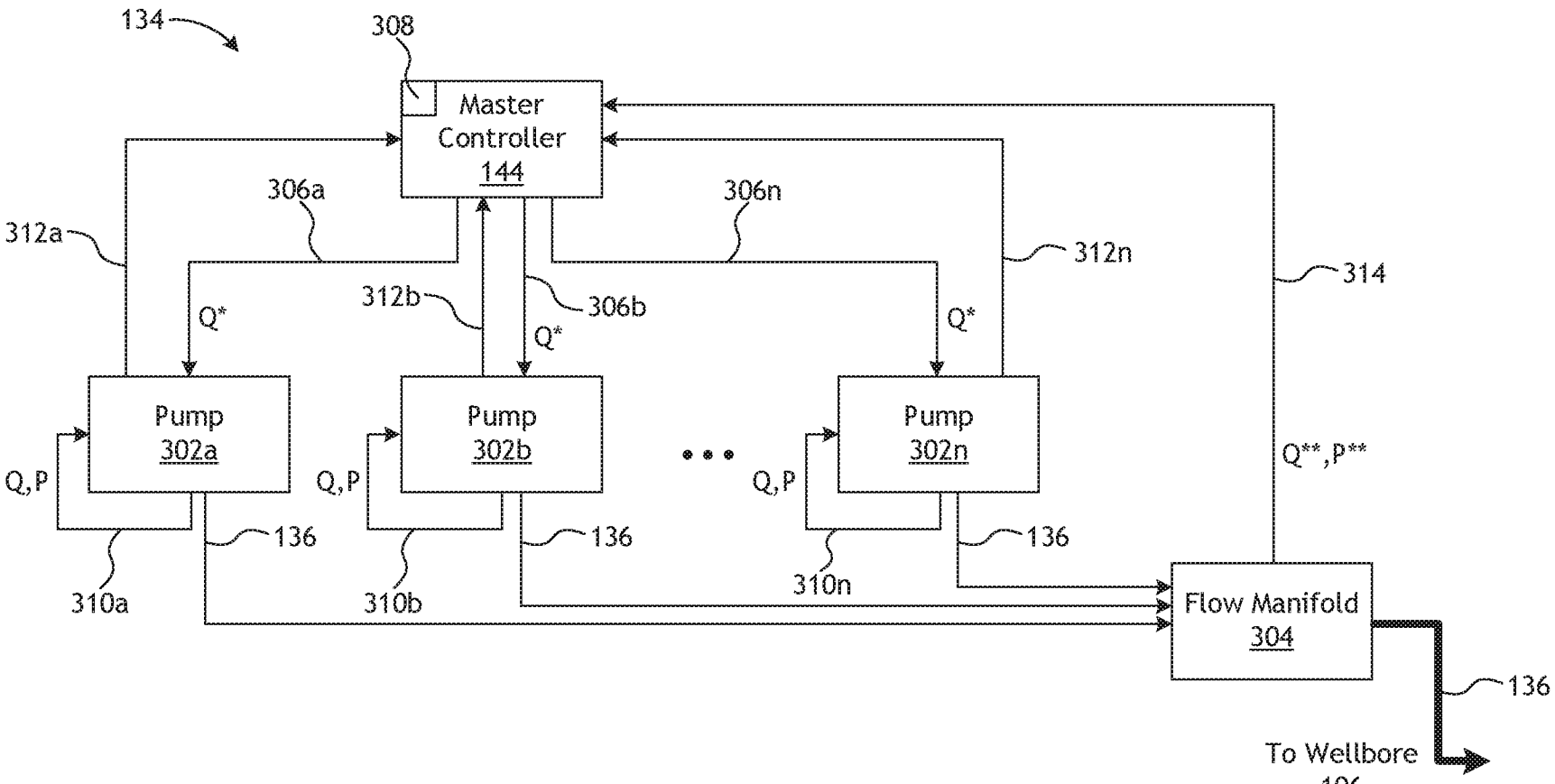
FIG. 3 is a schematic diagram of the control layout for the master controller of FIG. 1.

FIG. 3 is a schematic diagram of the control layout for select features of the fracturing control system 134 of FIG. 1, according to one or more embodiments. In the illustrated schematic, the fracturing control system 134 includes a plurality of pumps, shown as pumps 302*a*, 302*b*, . . . , and 302*n*, where each pump 302*a-n* forms part of the pump system 142 of FIG. 1. Use of the variable "n" with respect to pump 302*n* indicates that any number of pumps may be used in the fracturing control system 134, without departing from the scope of the disclosure. Each pump 302*a-n* may be indicative of a single, discrete pump, but, as mentioned above, could alternatively comprise multiple pumps included on or forming part of a pump truck stationed at a rig site. The output of each pump 302*a-n* comprises fracturing fluid 136 that is conveyed to a flow manifold 304 where the separate streams of fracturing fluid 136 are combined to be fed into the wellbore 106, such as via a wellhead installation or the like.

The master controller 144 is programmed and otherwise configured to control operation of the pumps 302*a-n* such that a predetermined or required flow rate and pressure of the fracturing fluid 136 is conveyed to the wellbore 106. To accomplish this, the master controller 144 issues or provides discrete command signals to each pump 302*a-n*, shown in FIG. 3 as command signals 306*a*, 306*b*, . . . , and 306*n*. The command signals 306*a-n* may be conveyed via any known wired or wireless telecommunication means. Each command signal 306*a-n* directs the corresponding pump 302*a-n* to operate such that a predetermined flow rate of the fracturing fluid 136 is conveyed to the flow manifold 304 for introduction into the wellbore 106.

The master controller 144 may be configured to define each pump 302*a-n*, which includes storing operational and device parameters for each pump 302*a-n* in an onboard memory 308. Each pump 302*a-n*, for example, may include multiple sequential gears used to dictate the resulting flow rate producible by each pump 302*a-n*, and such device parameters may be stored in the onboard memory 308. Accordingly, the master controller 144 may be able to access and query pump capabilities and limitations for each pump 302*a-n* and, based on the known operational and device parameters, the master controller 144 may be programmed to define an order that the pumps 302*a-n* are engaged (initiated) during operation to reach a target flow rate for each incremental flow rate step. The master controller 144 further ensures that each pump 302*a-n* that is part of a flow rate step increase is quickly ramped up to a lockout point (i.e., operating in a desired gear) and any additional pumps

302*a-n* required to achieve the target flow rate at the given step are engaged via the command signals 306*a-n*.

The master controller 144 may be configured to automatically adjust the required flow rate for the fracturing operation based on real-time operational parameters and information, and thereby ensure that proper ramping up to each target flow rate is achieved. To accomplish this, the fracturing control system 134 may include multiple feedback loops. As illustrated, for example, each pump 302*a-n* in the fracturing control system 134 may include a local feedback loop, shown as local feedback loops 310*a*, 310*b*, . . . , 310*n*. Moreover, each pump 302*a-n* may further include a master feedback loop, shown as master feedback loops 312*a*, 312*b*, . . . , 312*n*. The local and master feedback loops 310*a-n*, 312*a-n* may each comprise, for example, a closed-loop control mechanism or program, such as a proportional controller (P), a differential controller (D), an integrative controller (I), or a combination thereof such as a PID (proportional, integral, derivative) controller.

The local feedback loops 310*a-n* monitor and control the output of each corresponding pump 302*a-n*. More particularly, the real-time flow rate Q and pressure P of each pump 302*a-n* may be measured downstream from its corresponding outlet. The local feedback loops 310*a-n* allow the measured flow rate Q to be compared against the commanded flow rate Q* dictated by the corresponding command signal 306*a-n* provided by the master controller 144. If there is a difference between the measured flow rate Q and the commanded flow rate Q*, the pump 302*a-n* may include local controllers configured to automatically adjust its operation to account for the difference and bring the measured flow rate Q into operational alignment with the commanded flow rate Q*. Each local feedback loop 310*a-n* may have different control gains based on the particular pump gear, the measured flow rate Q, the commanded flow rate Q*, or the measured pressure P.

Each master feedback loop 312*a-n* provides operational feedback data to the master controller 144 from each pump 302*a-n*. The operational feedback data provided to the master controller 144 can include the real-time measured flow rate Q and measured pressure P. The measured pressure P, for instance, may be used as a conditioner on the master controller 144 to ensure that the given pump 302*a-n* does not adjust into a region of instability, inefficiency, excessive wear, or otherwise undesirable poor performance. Additional operational feedback data provided to the master controller 144 from each pump 302*a-n* may include, but is not limited to, the currently-engaged pump gear, the commanded flow rate Q*, the minimum flow rate capacity in the currently-engaged pump gear, the maximum flow rate capacity in the currently-engaged pump gear, the minimum and/or maximum flow rate capacity in the next pump gear, the maximum pressure in the currently-engaged pump gear, the maximum pressure in the next pump gear, and the kick out pressure (i.e., the maximum pressure for the wellbore 106). Based on the operational feedback data, the master controller 144 may be configured to alter (modify) operation of one or more of the pumps 302*a-n* by sending additional command signals 306*a-n*. For instance, the master controller 144 may place the pumps 302*a-n* in a certain operational sequence or order based on the operational feedback data and engage (operate) the pumps based on that certain order.

In some embodiments, each pump 302*a-n* provides all of the aforementioned operational feedback data to the master controller 144 via its corresponding master feedback loop 312*a-n*. In other embodiments, one or more of the pumps 302*a-n* may provide different amounts of the aforementioned operational feedback data to the master controller 144, without departing from the scope of the disclosure. In some applications, the most important operational feedback data provided to the master controller 144 via the master feedback loops 312*a-n* may be the measured flow rate Q from each pump 302*a-n* and the maximum flow rate capacity in the currently-engaged pump gear. Instead of providing the measured flow rate Q, the actual value provided to the master controller 144 may be the rotations per minute (RPM) of the corresponding pump 302*a-n* or some other parameter that can be used to calculate the measured flow rate Q. The master controller 144 could also use the measured RPM and skip calculation of the measured flow rate Q, as long as the parameter is correlated with the flow rate.

In some embodiments, the fracturing control system 134 may further include a target feedback loop 314 providing the master controller 144 with feedback data corresponding to the real-time, measured total flow rate Q and total pressure P of the fracturing fluid 136 being conveyed into the wellbore 106. The total pressure P of the fracturing fluid 136 can be measured at various locations prior to the wellbore 106. In the illustrated embodiment, for example, the total pressure P can be measured at the flow manifold 304. In other embodiments, however, the total pressure P can be measured prior to the flow manifold 304 but after the pumps 302***a-n* or after the flow manifold 304. The total flow rate Q may similarly be measured before, at, or after the flow manifold 304. Based on the real-time, measured total flow rate Q and total pressure P of the fracturing fluid 136, the master controller 144 may be configured to alter (modify) operation of one or more of the pumps 302***a-n* by sending additional command signals 306*a-n*.

In some embodiments, the local feedback loops 310*a-n* may be omitted from the fracturing control system 134. In such embodiments, the pumps 302*a-n* may be run on an "open loop" configuration that receives the commanded flow rate Q* from the master controller 144. The master controller 144 can either specify a desired pump gear for the commanded flow rate Q* or each pump 302*a-n* can autonomously determine the appropriate gear based on the commanded flow rate Q*. Moreover, in an open loop configuration, the master controller 144 continues to sequence the pumps 302*a-n* to balance the load across the pumps 302*a-n*. The pumps 302*a-n* would continue to operate in the same operating pressure regime so that a rise in the injection pressure at the wellbore 106 would affect all of the pumps 302*a-n* at about the same pressure range.

Figure 4:
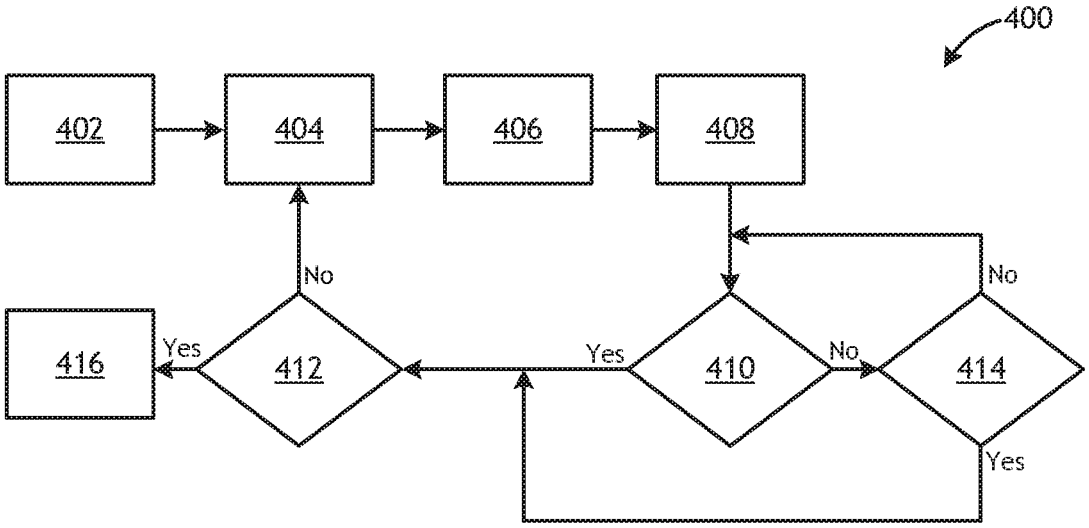
FIG. 4 is a schematic flow diagram of example operation of the master controller of FIG. 1.

FIG. 4 is a schematic flow diagram 400 of example operation of the fracturing control system 134, according to one or more embodiments. It is noted that the flow diagram 400 is only one example of operating the fracturing control system 134 and, therefore, should not be considered to limit the scope of the present disclosure. Prior to using the fracturing control system 134 to control a hydraulic fracturing operation, a user (e.g., a well operator) will input the following user-defined variables into the master controller 144: $Q_{Max}$, $P_{Max}$, $Q_{Step}$, $T_{Wait}$, $T_{Eval}$, and $\Delta P_{Min}$.

$Q_{Max}$: measured in barrels per minute (BPM), $Q_{Max}$ is the maximum flow rate to be reached during the hydraulic fracturing operation, at which point the fracturing control system 134 is turned off or placed on idle so as to not damage the wellbore 106 (FIG. 1).

$P_{Max}$: the maximum pressure value to be reached during the hydraulic fracturing operation.

$Q_{Step}$: also measured in BPM, $Q_{Step}$ is the total magnitude set point for each incremental flow rate step increase.

$T_{Wait}$: the minimum holding time before the slope of the pressure-time curve 200*b* (FIG. 2) is evaluated and a subsequent flow rate step increase is performed. $T_{Wait}$ allows the fracturing control system 134 to stabilize.

$\Delta T_{Eval}$: the fixed time period lapsed before positively determining a decrease in pressure or the slope of the pressure-time curve 200*b*; $T_{Eval}=T_{current}-\Delta T_{Eval}$.

$\Delta P_{Min}$: the minimum pressure drop required to initiate the next flow rate step increase and may be measured from when $T_{Wait}$ is achieved or may alternatively be measured over a real-time progressing evaluation of the pressure ($P_{Eval}$).

With reference to the flow diagram 400, the fracturing control system 134 is first turned "on" or initiated, as at box 402. Once the fracturing control system 134 is turned on, the master controller 144 may be triggered to initiate the first flow rate step increase at the input magnitude flow rate $Q_{Step}$, as at box 404. In some cases, the first flow rate step $Q_{Step}$ increase may comprise the closest achievable (rounded up) value based on the types of pumps (e.g., pumps 302*a-n* of FIG. 3) used, the flow manifold 304 (FIG. 3), and/or the desired treating pressure for the first step. Eventually, the target flow rate for the first step will be reached, as at box 406. At this point, the flow rate will be held (maintained) for the $T_{Wait}$ period before any evaluation or sequential flow rate step decisions are made, as at 408.

Once the $T_{Wait}$ period expires, the pressure may be evaluated by comparing the pressure measured back in time defined by $T_{Eval}$ ($P_{Eval}$) against the current pressure ($P_{Current}$) to determine if the pressure has exceeded an input pressure threshold ($\Delta P_{Min}$) requirement (e.g., $P_{Eval}-P_{Current}) \geq \Delta P_{Min}$), as at diamond 410, where $P_{Eval}$ is the pressure at $T_{Current}-\Delta T_{Eval}$. If the input pressure threshold $\Delta P_{Min}$ is met upon expiration of $T_{Wait}$ ("YES"), or over future $T_{Eval}$ periods, a check of the maximum flow rate $Q_{Max}$ and the maximum pressure $P_{Max}$ may be made, as at diamond 412. If, however, the input pressure threshold $\Delta P_{min}$ is not met upon expiration of $T_{Wait}$ ("NO"), the current pressure $P_{Current}$ will be continuously monitored until either the input pressure threshold $\Delta P_{min}$ is met or until expiration of a maximum holding time period for each step ($T_{Max}$), as at diamond 414. In some embodiments, $T_{Max}$ may be a period fixed as a multiple of $T_{Wait}$ (e.g., $T_{Max}=5\times T_{Wait}$). Accordingly, at diamond 414, as long as the current time $T_{Current}$ is less than the maximum holding time $T_{Max}$ ("NO"), the current pressure $P_{Current}$ will be continuously monitored until the input pressure threshold $\Delta P_{min}$ is met. If, however, the $T_{Max}$ period expires ("YES"), the maximum flow rate $Q_{Max}$ and the maximum pressure $P_{Max}$ will be measured, as at diamond 412.

If the maximum flow rate $Q_{Max}$ and the maximum pressure $P_{Max}$ are not met at diamond 412 ("NO"), the next flow rate step increase in the fracturing process may commence by initiating a second flow rate step increase at the input magnitude flow rate $Q_{Step}$, as at box 404 again. The method may then proceed as outlined above from box 404. If, however, the maximum flow rate $Q_{Max}$ and/or the maximum pressure $P_{Max}$ are met ("YES"), then operation of the fracturing control system 134 may be shut down or placed on hold, as at box 416. If the fracturing control system 134 is placed on hold, the fracturing process will be maintained at the current state and some or all of the timing parameters (e.g., $T_{Max}$, $T_{Wait}$, $T_{Current}$, $T_{Eval}$, etc.) will be placed on hold until the fracturing control system 134 is removed from hold. While the fracturing control system 134 is placed on hold, the master controller 144 will be unable to make any more steps or decisions.

In some embodiments, the fracturing control system 134 may operate according to a set of rules. One rule programmed into the fracturing control system 134 and, more particularly into the master controller 144, may be that while the rate step magnitude $Q_{Step}$ is user defined, it is limited by the lock-up of the gears of the pumps 302*a-n* (FIG. 3), since pump transmissions have limited range of efficient operation. If the rate step magnitude $Q_{Step}$ does not fit within the operating range of the pump gears, then the master controller 144 may be programmed to specify a different flow rate that matches the efficient flow rate steps available by the pumps 302*a-n*. In other words, if an input rate step magnitude $Q_{Step}$ is lower than the minimum engagement rate for the number of pumps 302*a-n* required, then the rate step magnitude $Q_{Step}$ may be increased to the minimum set point achievable for the number of pumps 302*a-n* required. This rule is based upon the mechanical capability of the pumps 302*a-n* (e.g., the pump truck carrying the pumps 302*a-n*).

Another rule that may be applied (programmed) to the fracturing control system 134 may be that the time ($\Delta T_{Eval}$) required to evaluate a decrease in pressure or the slope of the pressure-time curve 200*b* (FIG. 2) must be less than or equal to the minimum holding time ($T_{Wait}$) before the slope of the pressure-time curve 200*b* is evaluated and a subsequent flow rate step increase is performed. Since $\Delta T_{Eval}$ may be a fixed number, it should not be larger than $T_{Wait}$. If it were larger than $T_{Wait}$, a pressure reading could be obtained before the rate step was actually taken.

Yet another rule that may be applied (programmed) to the fracturing control system 134 may be that the pump rate allocation logic will first engage all the pumps 302*a-n* (FIG. 3) sequentially as required by flow rate needs. The flow rate of each pump 302*a-n* may then be increased as needed. Unless a particular pump has been excluded from the available pump list by the well operator, or if a pump has been set by the well operator to engage in a higher gear than the lowest lock up gear, all pumps 302*a-n* will be engaged in the lowest available lock up gear before any other pump is brought to the next highest gear.

Figure 5:
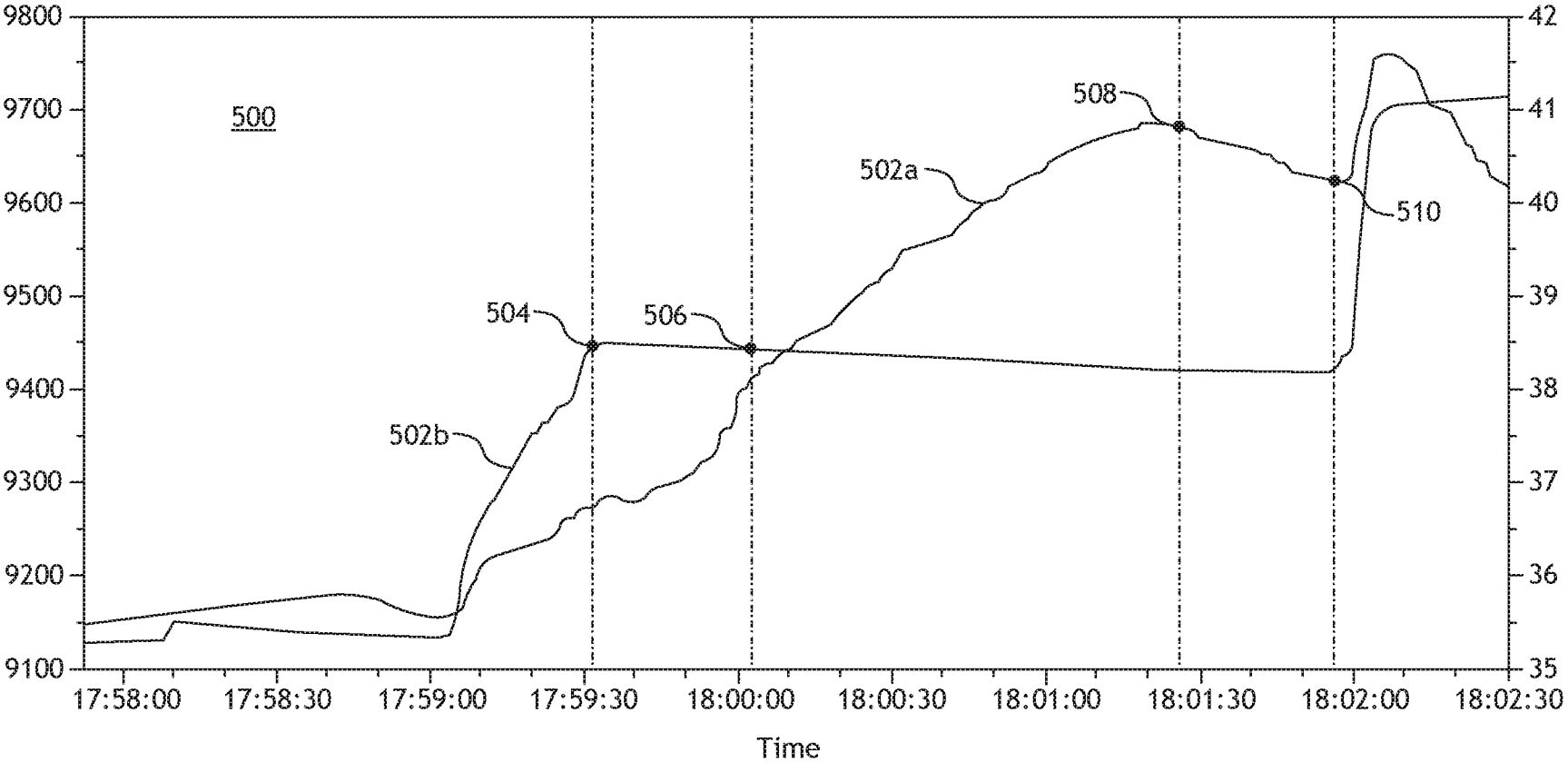
FIG. 5 is a plot that reflects example automated operation of the fracturing control system of FIG. 1.

FIG. 5 is a plot 500 showing example automated operation of the fracturing control system 134. The plot 500 includes a pressure curve 502*a* and a flow rate curve 502*b* each plotted contiguously against time (x-axis). At about time 17:59:00, the fracturing control system 134 is turned on and the master controller 144 initiates the first flow rate increase. The flow rate increases until reaching a target flow rate set point 504, at which point the flow rate is maintained while the pressure continues to increase. At point 506, the minimum holding time ($T_{Wait}$) has been reached and evaluation of $\Delta P_{min}$ can begin. In some applications, as illustrated, the flow rate may gently (slightly) decrease with time, but could alternatively gently (slightly) increase with time or remain substantially constant. A flow rate increase is not initiated until about time 18:01:25 because $\Delta P_{min}$ has not been satisfied nor has $T_{Max}$ been reached. At point 508, however, the pressure curve 502*a* begins to decrease, which may refer to the time ($T_{Eval}$) required before a decrease in the slope of the pressure curve 502*a* can be detected (i.e., $\Delta T_{Eval}$=time at point 510− time at point 508). At point 510, the current pressure ($P_{Current}$) is measured to determine if the minimum pressure drop is reached, $(P_{Eval}-P_{Current}) \geq \Delta P_{Min}$ at which point another flow rate increase is initiated for the next step. The plot 500 shows that a flow rate step is not taken based upon measured time only, but also relying on measured pressure data.

The various embodiments described herein are directed to computer control for the master controller 144 and use various blocks, modules, elements, components, methods, and algorithms that can be implemented using computer hardware, software, combinations thereof, and the like. To illustrate this interchangeability of hardware and software, various illustrative modules, elements, components, methods and algorithms have been described generally in terms of their functionality. Whether such functionality is implemented as hardware or software will depend upon the particular application and any imposed design constraints. For at least this reason, it is to be recognized that one of ordinary skill in the art can implement the described functionality in a variety of ways for a particular application. Further, various components and blocks can be arranged in a different order or partitioned differently, for example, without departing from the scope of the embodiments expressly described.

Computer hardware used to implement the various illustrative blocks, modules, elements, components, methods, and algorithms described herein can include a processor configured to execute one or more sequences of instructions, programming stances, or code stored on a non-transitory, computer-readable medium. The processor can be, for example, a general purpose microprocessor, a microcontroller, a digital signal processor, an application specific integrated circuit, a field programmable gate array, a programmable logic device, a controller, a state machine, a gated logic, discrete hardware components, an artificial neural network, or any like suitable entity that can perform calculations or other manipulations of data. In some embodiments, computer hardware can further include elements such as, for example, a memory (e.g., random access memory (RAM), flash memory, read only memory (ROM), programmable read only memory (PROM), erasable read only memory (EPROM)), registers, hard disks, removable disks, CD-ROMS, DVDs, or any other like suitable storage device or medium.

Executable sequences described herein can be implemented with one or more sequences of code contained in a memory. In some embodiments, such code can be read into the memory from another machine-readable medium. Execution of the sequences of instructions contained in the memory can cause a processor to perform the process steps described herein. One or more processors in a multi-processing arrangement can also be employed to execute instruction sequences in the memory. In addition, hard-wired circuitry can be used in place of or in combination with software instructions to implement various embodiments described herein. Thus, the present embodiments are not limited to any specific combination of hardware and/or software.

As used herein, a machine-readable medium will refer to any medium that directly or indirectly provides instructions to a processor for execution. A machine-readable medium can take on many forms including, for example, non-volatile media, volatile media, and transmission media. Non-volatile media can include, for example, optical and magnetic disks. Volatile media can include, for example, dynamic memory. Transmission media can include, for example, coaxial cables, wire, fiber optics, and wires that form a bus. Common forms of machine-readable media can include, for example, floppy disks, flexible disks, hard disks, magnetic tapes, other like magnetic media, CD-ROMs, DVDs, other like optical media, punch cards, paper tapes and like physical media with patterned holes, RAM, ROM, PROM, EPROM and flash EPROM.

Embodiments disclosed herein include:

A. A method for hydraulically fracturing a subterranean formation that includes preparing and sending a first command signal from a master controller to a plurality of pumps of a pump system, wherein the first command signal specifies a flow rate output for each pump of the plurality of pumps to achieve a first target flow rate for a fracturing fluid being injected into the subterranean formation, injecting the fracturing fluid into the subterranean formation at the first target flow rate, monitoring over time a pressure of the fracturing fluid injected into the subterranean formation at the first target flow rate, based on the pressure of the fracturing fluid injected into the subterranean formation, determining with the master controller when to increase a flow rate of the fracturing fluid to a second target flow rate, preparing and sending a second command signal from the master controller to the plurality of pumps, wherein the second command signal specifies the flow rate output for each pump to achieve the second target flow rate, and injecting the fracturing fluid into the subterranean formation at the second target flow rate.

B. A fracturing control system that includes a fluid system that mixes and dispenses a fracturing fluid, a proppant system that conveys proppant to the fluid system to be included in the fracturing fluid, a pump system including a plurality of pumps that receive and convey the fracturing fluid into a wellbore to hydraulically fracture a subterranean formation, a master controller communicably coupled to and configured to operate the fluid system, the proppant system, and the pump system, wherein the master controller comprises a computer programmed to prepare and send a first command signal from a master controller to the plurality of pumps and thereby specify a flow rate output for each pump to achieve a first target flow rate for the fracturing fluid being injected into the subterranean formation, monitor over time a pressure of the fracturing fluid injected into the subterranean formation at the first target flow rate, determine when to increase a flow rate of the fracturing fluid to a second target flow rate based on the pressure of the fracturing fluid injected into the subterranean formation, and prepare and send a second command signal to the plurality of pumps and thereby specify the flow rate output for each pump to achieve the second target flow rate.

Each of embodiments A and B may have one or more of the following additional elements in any combination: Element 1: wherein determining with the master controller when to increase the flow rate of the fracturing fluid to the second target flow rate comprises measuring a maximum pressure at the first target flow rate, calculating a slope of the pressure versus time after reaching the maximum pressure, and determining to increase the flow rate of the fracturing fluid to the second target flow rate upon establishing that the slope is negative. Element 2: wherein determining with the master controller when to increase the flow rate of the fracturing fluid to the second target flow rate comprises measuring a maximum pressure at the first target flow rate, and determining to increase the flow rate of the fracturing fluid to the second target flow rate upon expiration of a predetermined time period following measurement of the maximum pressure. Element 3: wherein determining with the master controller when to increase the flow rate of the fracturing fluid to the second target flow rate comprises measuring a maximum pressure at the first target flow rate, calculating a time period elapsed between sending the first command signal and when the maximum pressure is measured, and increasing the flow rate of the fracturing fluid to the second target flow rate upon expiration of the time period after measuring the maximum pressure. Element 4: further comprising increasing the flow rate of the fracturing fluid to the first and second target flow rates at a constant rate. Element 5: further comprising increasing the flow rate of the fracturing fluid to at least one of the first and second target flow rates at a variable rate. Element 6: further comprising increasing the flow rate of the fracturing fluid to the second target flow rate based on the pressure of the fracturing fluid at the first target flow rate as measured over time. Element 7: further comprising measuring a slope of the pressure of the fracturing fluid at the first target flow rate as measured over time, and increasing the flow rate of the fracturing fluid to the second target flow rate based on the slope. Element 8: wherein each pump includes a local feedback loop, the method further comprising obtaining a measured flow rate of the fracturing fluid, comparing the measured flow rate against the flow rate output specified by the first command signal with each local feedback loop, and adjusting operation of the corresponding pump with each local feedback loop when a difference between the measured flow rate and first command signal is determined. Element 9: wherein each pump includes a master feedback loop, the method further comprising providing operational feedback data to the master controller via each master feedback loop, and modifying operation of one or more of the plurality of pumps based on the operational feedback data.

Element 10: further comprising a local feedback loop associated with each pump, wherein each local feedback loop monitors and controls an output of each corresponding pump. Element 11: wherein each local feedback loop compares a measured flow rate against the flow rate output specified by the first command signal and adjusts operation of the corresponding pump when a difference between the measured flow rate and first command signal is determined. Element 12: wherein the local feedback loop for each pump comprises a closed-loop control mechanism selected from the group consisting of a proportional controller, a differential controller, an integrative controller, or a combination thereof. Element 13: further comprising a master feedback loop associated with each pump to provide operational feedback data to the master controller from each corresponding pump. Element 14: wherein the operational feedback data is selected from the group consisting of real-time measured flow rate, real-time measured pressure, a currently-engaged pump gear, a commanded flow rate, a minimum flow rate capacity in the currently-engaged pump gear, a maximum flow rate capacity in the currently-engaged pump gear, a minimum and/or maximum flow rate capacity in an additional pump gear, a maximum pressure in the currently-engaged pump gear, a maximum pressure in the additional pump gear, and kick out pressure. Element 15: further comprising a target feedback loop communicably coupled to the master controller to provide the master controller with feedback data corresponding to real-time total flow rate and total pressure of the fracturing fluid injected into the subterranean formation. Element 16: wherein the flow rate of the fracturing fluid is increased to the second target flow rate based on a slope of the pressure versus time after reaching a maximum pressure at the first target flow rate. Element 17: wherein the flow rate of the fracturing fluid is increased to the second target flow rate upon expiration of a predetermined time period following measurement of a maximum pressure at the first target flow rate. Element 18: wherein the flow rate of the fracturing fluid is increased to the second target flow rate after measuring a maximum pressure at the first target flow rate and upon expiration of a time period elapsed between sending the first command signal and when the maximum pressure is measured.

By way of non-limiting example, exemplary combinations applicable to A and B include: Element 6 with Element 7; Element 10 with Element 11; Element 10 with Element 12; and Element 13 with Element 14.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. A method for hydraulically fracturing a subterranean formation, comprising:

preparing and sending a first command signal from a master controller to a plurality of pumps of a pump system, wherein the first command signal specifies a flow rate output for each pump of the plurality of pumps to achieve a first target flow rate for a fracturing fluid being injected into the subterranean formation;

injecting the fracturing fluid into the subterranean formation at the first target flow rate;

monitoring over time a pressure of the fracturing fluid injected into the subterranean formation at the first target flow rate;

based on the pressure of the fracturing fluid injected into the subterranean formation, determining with the master controller when to increase a flow rate of the fracturing fluid to a second target flow rate; wherein determining with the master controller when to increase the flow rate of the fracturing fluid to the second target flow rate comprises:

measuring a maximum pressure at the first target flow rate;

calculating a slope of the pressure versus time after reaching the maximum pressure; and determining to increase the flow rate of the fracturing fluid to the second target flow rate upon establishing that the slope is negative, preparing and sending a second command signal from the master controller to the plurality of pumps, wherein the second command signal specifies the flow rate output for each pump to achieve the second target flow rate; and injecting the fracturing fluid into the subterranean formation at the second target flow rate.

2. The method of claim 1, wherein determining with the master controller when to increase the flow rate of the fracturing fluid to the second target flow rate comprises:

measuring a maximum pressure at the first target flow rate; and determining to increase the flow rate of the fracturing fluid to the second target flow rate upon expiration of a predetermined time period following measurement of the maximum pressure.

3. The method of claim 1, wherein determining with the master controller when to increase the flow rate of the fracturing fluid to the second target flow rate comprises:

measuring a maximum pressure at the first target flow rate;

calculating a time period elapsed between sending the first command signal and when the maximum pressure is measured; and increasing the flow rate of the fracturing fluid to the second target flow rate upon expiration of the time period after measuring the maximum pressure.

4. The method of claim 1, further comprising increasing the flow rate of the fracturing fluid to the first and second target flow rates at a constant rate.

5. The method of claim 1, further comprising increasing the flow rate of the fracturing fluid to at least one of the first and second target flow rates at a variable rate.

6. The method of claim 1, further comprising increasing the flow rate of the fracturing fluid to the second target flow rate based on the pressure of the fracturing fluid at the first target flow rate as measured over time.

7. The method of claim 6, further comprising:

measuring a slope of the pressure of the fracturing fluid at the first target flow rate as measured over time; and increasing the flow rate of the fracturing fluid to the second target flow rate based on the slope.

8. The method of claim 1, wherein each pump includes a local feedback loop, the method further comprising:

obtaining a measured flow rate of the fracturing fluid;

comparing the measured flow rate against the flow rate output specified by the first command signal with each local feedback loop; and adjusting operation of the corresponding pump with each local feedback loop when a difference between the measured flow rate and first command signal is determined.

9. The method of claim 1, wherein each pump includes a master feedback loop, the method further comprising:

providing operational feedback data to the master controller via each master feedback loop; and modifying operation of one or more of the plurality of pumps based on the operational feedback data.

10. A fracturing control system, comprising:

a fluid system that mixes and dispenses a fracturing fluid;

a proppant system that conveys proppant to the fluid system to be included in the fracturing fluid;

a pump system including a plurality of pumps that receive and convey the fracturing fluid into a wellbore to hydraulically fracture a subterranean formation;

a master controller communicably coupled to and configured to operate the fluid system, the proppant system, and the pump system, wherein the master controller comprises a computer programmed to:

prepare and send a first command signal from a master controller to the plurality of pumps and thereby specify a flow rate output for each pump to achieve a first target flow rate for the fracturing fluid being injected into the subterranean formation;

monitor over time a pressure of the fracturing fluid injected into the subterranean formation at the first target flow rate;

determine when to increase a flow rate of the fracturing fluid to a second target flow rate based on the pressure of the fracturing fluid injected into the subterranean formation; wherein the flow rate of the fracturing fluid is increased to the second target flow rate after measuring a maximum pressure at the first target flow rate and upon expiration of a time period elapsed between sending the first command signal and when the maximum pressure is measured; and prepare and send a second command signal to the plurality of pumps and thereby specify the flow rate output for each pump to achieve the second target flow rate.

11. The fracturing control system of claim 10, further comprising a local feedback loop associated with each pump, wherein each local feedback loop monitors and controls an output of each corresponding pump.

12. The fracturing control system of claim 11, wherein each local feedback loop compares a measured flow rate against the flow rate output specified by the first command signal and adjusts operation of the corresponding pump when a difference between the measured flow rate and first command signal is determined.

13. The fracturing control system of claim 11, wherein the local feedback loop for each pump comprises a closed-loop control mechanism selected from the group consisting of a proportional controller, a differential controller, an integrative controller, and any combination thereof.

14. The fracturing control system of claim 10, further comprising a master feedback loop associated with each pump to provide operational feedback data to the master controller from each corresponding pump.

15. The fracturing control system of claim 14, wherein the operational feedback data is selected from the group consisting of real-time measured flow rate, real-time measured pressure, a currently-engaged pump gear, a commanded flow rate, a minimum flow rate capacity in the currently-engaged pump gear, a maximum flow rate capacity in the currently-engaged pump gear, a minimum and/or maximum flow rate capacity in an additional pump gear, a maximum pressure in the currently-engaged pump gear, a maximum pressure in the additional pump gear, and kick out pressure.

16. The fracturing control system of claim 10, further comprising a target feedback loop communicably coupled to the master controller to provide the master controller with feedback data corresponding to real-time total flow rate and total pressure of the fracturing fluid injected into the subterranean formation.

17. The fracturing control system of claim 10, wherein the flow rate of the fracturing fluid is increased to the second target flow rate based on a slope of the pressure versus time after reaching a maximum pressure at the first target flow rate.

18. The fracturing control system of claim 10, wherein the flow rate of the fracturing fluid is increased to the second target flow rate upon expiration of a predetermined time period following measurement of a maximum pressure at the first target flow rate.

19. The method of claim 1, wherein the subterranean formation is accessed offshore.

20. The system of claim 10, wherein the fracturing control system is located on an offshore rig.

* * * * *